US011576451B2

(12) United States Patent
Wexelbaum

(10) Patent No.: US 11,576,451 B2
(45) Date of Patent: Feb. 14, 2023

(54) DUAL BAND ADJUSTABLE BELT LOOP FASTENING DEVICE

(71) Applicant: Lucida, LLC, Naples, FL (US)

(72) Inventor: Joshua Wexelbaum, Naples, FL (US)

(73) Assignee: Lucida, LLC, Naples, FL (US)

( * ) Notice: Subject to any disclaimer, the term of this patent is extended or adjusted under 35 U.S.C. 154(b) by 148 days.

(21) Appl. No.: 17/012,746

(22) Filed: Sep. 4, 2020

(65) Prior Publication Data

US 2022/0071328 A1 Mar. 10, 2022

(51) Int. Cl.
*A41F 9/00* (2006.01)
*A45F 5/02* (2006.01)

(52) U.S. Cl.
CPC ..... *A41F 9/007* (2013.01); *A45F 5/021* (2013.01)

(58) Field of Classification Search
CPC ..... A41D 2400/42; A41D 2400/424; A44B 18/0007; A44B 18/0011; A44B 18/0015; A44B 18/0019; A44B 18/0053; A44B 18/0057; A44B 18/0061; A44B 18/0065; A44B 18/0023; A44B 18/003; A44B 18/0034; A44B 18/0038; A44B 18/0042; A45F 2005/023; A45F 2200/05; A45F 2200/0566; A45F 2200/0575; A45F 2200/0591; A45F 5/00; A45F 5/02; A45F 5/021; A45F 5/022; Y10T 24/2408; Y10T 24/314; Y10T 24/316
USPC ..... 24/3.1
See application file for complete search history.

(56) References Cited

U.S. PATENT DOCUMENTS

| | | | | |
|---|---|---|---|---|
| 8,172,080 | B1 * | 5/2012 | Schantz | B65D 85/18 206/781 |
| D750,343 | S * | 3/2016 | Biesel | D2/627 |
| 11,022,402 | B1 * | 6/2021 | Scott | F41C 33/048 |
| D955,569 | S * | 6/2022 | Weighill | D24/128 |
| 2009/0007316 | A1 * | 1/2009 | Escudero Munoz | A41F 1/00 2/311 |
| 2009/0139014 | A1 * | 6/2009 | Trochlil-Crist | A41F 9/002 2/338 |
| 2010/0235967 | A1 * | 9/2010 | Janakus | A41F 9/025 2/311 |
| 2014/0208485 | A1 * | 7/2014 | Kjar | A41D 1/21 2/312 |
| 2020/0253309 | A1 * | 8/2020 | Wexelbaum | A41F 9/007 |
| 2022/0132962 | A1 * | 5/2022 | Fusillo | A41F 9/025 2/237 |

* cited by examiner

*Primary Examiner* — Victor D Batson
*Assistant Examiner* — Amber Nicole Helms
(74) *Attorney, Agent, or Firm* — Shumaker, Loop & Kendrick, LLP

(57) ABSTRACT

A dual band adjustable belt loop fastening devices configured to extend between two or more belt loops on a garment and to selectively lessen the distance there between the belt loops to secure the waistline of a garment to a wearer that are also configured to affix/attach item such as holsters, smartphones, or tools thereon or therein while in use.

13 Claims, 13 Drawing Sheets

DUAL BAND ADJUSTABLE BELT LOOP FASTENING DEVICE

TECHNICAL HELD

The present invention relates to fastening devices, and more particularly, to dual band adjustable belt loop fastening device(s) that extend between two or more belt loops to selectively lessen the distance there between two consecutive belt loops by biasing them towards one another to secure the waistline of a garment to a wearer and are further configured for utility purposes such as temporarily affixing and/or attaching items thereon (e.g., tools, holster(s), phones, etc.) while in use.

BACKGROUND

Belts are traditional fastening devices used to reduce the overall waistline of a garment while further securing a garment to a wearer. Belts come in many forms (e.g., utilitarian forms devoid of decoration or aesthetically pleasing/decorative forms) and are often used with work, casual, and formal attire such as shorts, jeans, and dress slacks. While belts are very effective for securing a garment to a wearer and concurrently reducing a garment's overall waistline, problems exist with belt usage for those afflicted with various chronic illnesses and/or diseases (e.g., various inflammatory diseases) that are often associated with increased sensitivity and tenderness of the abdominal wall/lining. For example, people afflicted with Crohn's disease, irritable bowel syndrome (IBS), colitis, and/or other maladies affecting the gut and intestines often experience sharp pains and exhibit highly increased sensitivity and tenderness of the abdominal wall/lining, primarily in the rectus abdominis region and occasionally within the oblique region as well.

Due to increased abdominal sensitivity and tenderness in individuals afflicted with the above mentioned chronic illnesses/diseases, belt usage and the abdominal pressure applied by the belt to ones abdomen often leads to great discomfort requiring constant readjustment of the belt in an attempt to mitigate this discomfort while concurrently attempting to best secure the garment on the wearer. In many instances, this discomfort cannot be mitigated and people are forced to endure this discomfort while wearing the belt to securely maintain their garments in an appropriately desired position. However, in other instances, the discomfort and displeasure of wearing the belt becomes too great leading one to discontinue belt usage, thus resulting in an ill-fitting garment that constantly slips along the wearer's waist and further requires constant readjustment to properly maintain positioning of the garment on the wearer.

To further compound the above mentioned problems, ones afflicted with the above mentioned illnesses and/or diseases often experience vast weight fluctuation(s) associated with inflammation of the gut, intestines, and/or abdomen—frequently losing vast amounts of weight when (i) their condition is at its worst, (ii) abdominal sensitivity/tenderness is at its greatest, and (iii) when belts usage is needed the most to potentially secure an ill-fitting garment to the wearer. Thus, as detailed above, a problem clearly exists with belt usage especially in individuals having various chronic illnesses/diseases affecting the gut, intestines, and/or abdomen, and a viable alternative that alleviates the above mentioned problems (e.g., application of force/pressure on the abdomen and discomfort/displeasure associated therewith) while concurrently securing a garment to the wearer is direly needed. Moreover, in certain instances, some garment wearers merely dislike wearing a belt and/or suspenders, but are in need of viable, easy to use options for fastening and/or maintaining positioning of a garment to a wearer's waist.

SUMMARY

It is an object of the invention to provide a dual band adjustable belt loop fastening device that advantageously overcomes the above mentioned problems of conventional belts by being looped through and secured through only a partial number of a garment's belt loops to selectively lessen the distance there between (for example, two consecutive belt loops) by biasing them towards one another when the device is secured to the waistline of a garment. These dual band adjustable belt loop fastenings are further configured for utility purposes such as temporarily affixing and/or attaching items thereon (e.g., tools, holster(s), phones, etc.) while in use. In particular, disclosed herein are dual band adjustable belt loop fastening devices configured to extend between and be affixed to a plurality of belt loops on a garment and, while in use and affixed to the plurality of belt loops, to selectively lessen distance between belt loops by applying force directly to the belt loops to bias two belts loops towards one another to secure a garment waistline to a wearer and also configured to affix items thereon or thereto, the dual band adjustable belt loop fastening device comprising: (a) a first and second elastic band that are formed of different materials and are directly laterally adjacent to one another within the dual band adjustable belt loop fastening device, each elastic band having a substantially same elongated shape and a first end and a second end that are spaced apart relative to one another; and (b) a first fastening tab directly, permanently connected to each first end of each of the elastic bands and a second fastening tab directly permanently connected to each second end of each elastic bands, each fastening tab is more rigid than each elastic band and is configured to fold inwardly towards one another along a longitudinal axis ($L^1$) of the dual band adjustable belt loop fastening device and securely engage a portion of the first or second elastic band while in use to affix the device and selectively lessen distance between belt loops of the garment waistline.

In certain aspects, each elastic band of the dual band adjustable belt loop fastening device comprises a two way stretch fabric having greater stretch along the longitudinal axis ($D^1$) of the device than in other directions ($D^2$) of the device.

In certain aspects, one of the first and second elastic bands of the dual band adjustable belt loop fastening device has less elasticity than the other elastic band.

In certain aspects, each elastic band of the dual band adjustable belt loop fastening device is a woven fabric.

In certain aspects, the elastic band of the dual band adjustable belt loop fastening device having the least elasticity of the first and second elastic bands comprises a nylon and polyester blend and the elastic band having the most elasticity of the of the first and second elastic bands is a polyester fabric.

In certain aspects, the elastic band of the dual band adjustable belt loop fastening device having the least elasticity of the first and second elastic bands has hook or loop fasteners affixed on its outer surface that are configured to engage and temporarily fasten to the first and second fastening tabs.

In certain aspects, the first ends of the first and second elastic bands of the dual band adjustable belt loop fastening device converge with one another at a connection point of the first fastening tab with each first end and the first fastening tab permanently attached to one another, and the second ends of the first and second elastic bands of the dual band adjustable belt loop fastening device converge with one another at a connection point of the second fastening tab with each second end and the end fastening tab permanently attached to one another.

In certain aspects, the first and second elastic bands of the dual band adjustable belt loop fastening device are permanently secured to one another internally within the device along the longitudinal axis ($L^1$) of the device and form a plurality of openings extending from a top to bottom of the device along the longitudinal axis of the device, the plurality of openings formed in between the first ends and second ends of the first and second elastic bands.

In certain aspects, each of the plurality of openings of the dual band adjustable belt loop fastening device extend from a top to bottom of the device along the longitudinal axis ($L^1$) of the device are configured to receive items therein and/or securely attach items onto the dual band adjustable belt loop fastening device.

In certain aspects, the first and second fastening tabs of the dual band adjustable belt loop fastening device each have opposing first and second faces in which the first face of each fastening tab has the same hook or loop fasteners positioned thereon that are configured to fold inwardly towards (along axis $F^1$ and $F^2$) one another along axes that are transverse to the longitudinal axis ($L^1$) of the dual band adjustable belt loop fastening device and securely engage a portion of the first or second elastic band while in use to affix the device and selectively lessen distance between belt loops of the garment waistline. In certain preferred aspects, the first and second fastening tabs are more rigid than each elastic band. The first and second fastening tabs further comprise a non-woven substrate that aids in permanently attaching the first and second ends of each elastic band to each fastening tab and further aids in use and durability of the devices disclosed herein.

In certain aspects, a hook or loop fastener is arranged on a second face of either the first or second fastening tab but not both fastening tabs and is further configured to engage the hook and loop fasteners arranged on the first face of the other fastening tab while in use.

In certain aspects, a protective fabric is permanently attached over peripheral edges of each fastening tab to minimize abrasiveness and potential lacerations occurring when contacting the peripheral edges of each fastening tab.

In certain aspects, the device is configured to affix tools, holsters, smartphones, or any combination thereof on or within an opening in the device.

In a further aspect, also disclosed is a method of selectively lessening a distance between a plurality of belt loops comprising: (a) threading a dual band adjustable belt loop device disclosed herein between a plurality of belt loops; (b) engaging and securing a first belt loop within a first fastening tab of the device; and (c) applying force towards a second belt loop by pulling a second end of the adjustable belt loop device in a direction opposite the first belt loop; and engaging the second fastening tab of the dual band adjustable belt loop device to another portion of the device to selectively lessen distance between the first and second belt loops by gripping and applying force directly to the belt loops to bias the first and second belt loops towards one another, wherein: the dual band adjustable belt loop fastening device comprises: (i) a first and second elastic band that are formed of different materials and are directly laterally adjacent to one another within the dual band adjustable belt loop fastening device, each elastic band having a substantially same elongated shape and a first end and a second end that are spaced apart relative to one another; and (ii) a first fastening tab directly permanently connected to each first end of each of the elastic bands and a second fastening tab directly permanently connected to each second end of each of the elastic bands, each fastening tab is more rigid than each elastic band and configured to fold inwardly towards one another along a longitudinal axis ($L^1$) of the dual band adjustable belt loop fastening device and securely engage a portion of the first or second elastic band while in use to affix the device and selectively lessen distance between belt loops of the garment waistline.

In certain aspects, each elastic band of the device used in the method comprises a two way stretch fabric having greater stretch along the longitudinal axis ($D^1$) of the device than in other directions ($D^2$) of the device.

In certain aspects, one of the first and second elastic bands of the device used in the method has less elasticity than the other elastic band.

In certain aspects, the elastic band having the least elasticity of the first and second elastic bands of the device used in the method comprises a nylon and polyester blend and the elastic band having the most elasticity of the of the first and second elastic bands is a polyester fabric.

In certain aspects, the first ends of the first and second elastic bands of the device used in the method converge with one another at a connection point of the first fastening tab and the second ends of the first and second elastic bands converge with one another at a connection point of the second fastening tab.

In certain aspects, the first and second elastic bands of the device used in the method are permanently secured to one another internally within the device along the longitudinal axis ($D^1$) of the device and form a plurality of openings extending from a top to bottom of the device along the longitudinal axis of the device, the plurality of openings formed in between the first ends and second ends of the first and second elastic bands.

In certain aspects, each of the plurality of openings of the device used in the method extend from a top to bottom of the device along the longitudinal axis of the device are configured to receive items therein and/or securely attach items onto the device.

In certain aspects, the methods disclosed herein further include positioning and/or affixing a tool, holster, smartphone, or any combination thereof on or within an opening in the device.

Also disclosed herein is a kit comprising one or a plurality of adjustable belt loop fastening device(s) disclosed herein and packaging with the one or plurality of adjustable belt loop fastening device(s) packaged therein.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1A:
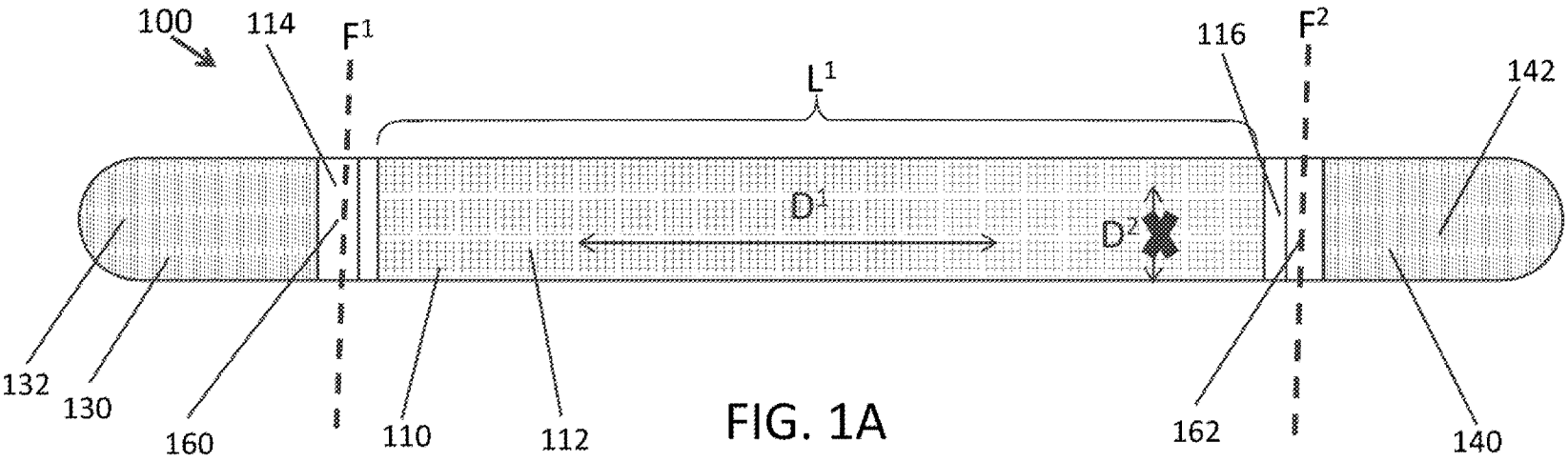
FIGS. 1A and 1B are front views of the dual band adjustable belt loop fastening devices having varied sizes.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

FIGS. 1A-7B depict the overall construction of the dual band adjustable belt loop fastening devices 100, 200. FIGS. 8-11B depict the dual band adjustable belt loop fastening devices 100, 200 in use in which the disclosed devices are affixed to a plurality of belt loops 601 of a garment 600 and are selectively lessening distance between belt loops (two consecutive belt loops) by applying force directly to the belt loops to bias the two belts loops towards one another thereby securing the garment waistline to a wearer while also advantageously affixing items thereon or thereto as desired by the device wearer.

As shown in FIGS. 1A-7B, the devices 100, 200 disclosed herein may vary in size (e.g., width/length) and may generally be available in various sizes such as small, medium, large, extra-large, etc. depending on the purpose of use and size of the wearer (e.g., merely fastening a garment versus the dual purpose of fastening a garment as well as service as a utility device in which items may be temporarily affixed/attached thereto and/or thereon). Generally and with reference to FIGS. 1A-7B, each device 100, 200 has the same overall construction. In particular and as further shown in FIGS. 1A-7B, the dual band adjustable belt loop fastening devices 100, 200 shown herein are configured to extend between and be affixed to a plurality of belt loops on a garment and, as further depicted in FIGS. 11A and 11B, while in use and affixed to the plurality of belt loops, to selectively lessen distance between belt loops by applying force directly to the belt loops to bias two belts loops towards one another to secure a garment waistline to a wearer. As shown, for example in FIGS. 11A and 11B, and unlike conventional belts, the devices herein are not configured to span/fasten along the entire length of a garment waistline. Instead, the devices 100, 200 disclosed herein merely span and fasten to a plurality of consecutive belt loops (e.g., two consecutive, three consecutive, or four consecutive belt loops) along a partial length of the garment waistline and are also configured to affix items thereon or thereto while secured to the garment/garment waistline.

As further shown in FIGS. 1A-7B, the dual band adjustable belt loop fastening devices 100, 200 disclosed herein include: (a) a first and second elastic band 110, 120, 210, 220 that are formed of different materials and are directly laterally adjacent to one another within the dual band adjustable belt loop fastening device, each elastic band having substantially the same elongated shape and a first end and a second end that are spaced apart relative to one another; and (b) a first fastening tab 130, 230 directly permanently connected to each first end 114, 214 of each of the elastic bands and a second fastening tab 140, 240 directly permanently connected to each second end 116, 216 of each of the elastic bands, each fastening tab 130, 140, 230, 240 is more rigid than each elastic band 110, 120, 210, 220 and is configured to fold inwardly towards one another along a longitudinal axis ($L^1$) of the dual band adjustable belt loop fastening device and securely engage a portion of the first or second elastic band while in use to affix the device and selectively lessen distance between belt loops of the garment waistline. While not in use and in a straightened state, the device 100, 200 and more particularly the fastening tabs 130, 140, 230, 240 that are positioned at opposite ends of the device, are co-planar (within a first plane), and extend in a direction away from one another. While in use, the device may have multiple different use/securing conformations. For example and as depicted in FIGS. 10A-11A, when the device 100, 200 is in use, the fastening tabs 130, 140, 230, 240 are folded along folding axis ($F^1$ or $F^2$) inwardly towards one another and are engaged to portions of one of the elastic bands such that the fastening tabs are substantially co-planar in a second plane. As further depicted in FIG. 11B and in certain aspects while the device 100, 200 is in use, the fastening tabs 130, 140, 230, 240 are folded along folding axis ($F^1$ or $F^2$) inwardly towards one another and a lower face of one fastening tab engages an upper face (hook and loop fastener complementary engagement) of another fastening tab such that the fastening tabs overlap and are directly laterally adjacent to one another but are not co-planar in either of the first or second planes mentioned immediately above.

Each elastic band 110, 120, 210, 220 of the dual band adjustable belt loop fastening device 100, 200, when included in its respective device, has a unique and different construction from one another, which enhances functionality and durability of the device. As shown in FIGS. 1A-2B, each elastic band preferably is a two way stretch fabric having greater stretch in a direction ($D^1$) that coincides and/or is parallel to the longitudinal axis ($L^1$) of the device 100, 200 than in other directions ($D^2$) of the device, and each elastic band 110, 120, 210, 220 of band adjustable belt loop fastening device 100, 200 is preferably a woven fabric. To further enhance functionality and durability, one of the first and second elastic bands 110, 120, 210, 220 of the dual band adjustable belt loop fastening device has less elasticity than the other elastic band. For example, the elastic band of the dual band adjustable belt loop fastening device 100, 200 having the least elasticity of the first and second elastic bands comprises a nylon and polyester blend while the elastic band having the most elasticity of the of the first and second elastic bands is a polyester fabric With specific reference to FIGS. 1A and 1B, the first elastic band 110, 210 has the most elasticity of the first and second elastic bands of the device. The first elastic band 110, 210 further has a planar face when viewed from the top, and when viewed from the side, the first elastic band 110, 210 further has undulating horizontal ridges and/or grooves (e.g., $HR^1$ (horizontal row 1) and $HR^2$ (horizontal row 2) in FIGS. 4A and 4B) formed within the first band (when viewed from the side) that coincide with and/or are substantially parallel to the longitudinal axis ($L^1$) of the device. These undulating ridges and grooves (e.g., $HR^1$ and $HR^2$ in FIGS. 4A and 4B) may be formed of bundled elastic yarns or threads or an elastomeric band (e.g., elongate band formed of an elastomer such as natural or artificial rubber) included within the first elastic bands woven construction, and further enhance the two-way properties of the first elastic band (i.e., two way stretch in direction ($D^1$) that coincides and/or is parallel to the longitudinal axis ($L^1$) of the device) While further increasing resistance to stretch in other directions ($D^2$) that are outside of the longitudinal axis ($L^1$) of the device. Because the first elastic band 110, 210 is configured to be directly laterally adjacent to the wearer's garment 600 while in use and to further experience intermittent friction from rubbing and/or contacting with the wearer's garment, the first elastic band 110, 210 further is more tightly woven than and may further include heavier fabric weight the second elastic band 120, 220 for durability and stretch purposes. With further reference to FIGS. 2A and 2B, the second elastic band 120, 220 of the dual band adjustable belt loop fastening device 100, 200 has the least elasticity of the first and second elastic bands. The second elastic band 120, 220 further includes hook or loop fasteners 112, 212 affixed on its outer surface that are configured to engage and temporarily fasten to the first and second fastening tabs 130, 140, 230, 240. The hook or loop fasteners 112, 212 are arranged in rows (e.g., $VR^1$ (vertical row 1) and $VR^2$ (vertical row 2)) that extend transverse relative to the longitudinal axis ($L^1$) of the device 100, 200 and relative to the undulating horizontal ridges and/or grooves of the first elastic band 110, 210. This transverse arrangement of hook or loop fasteners rows on the second elastic band 120, 220 relative to the undulating horizontal ridges and/or grooves (e.g., HR' and HR' in FIGS. 4A and 4B) formed within the first band further provides increased strength and durability to the device when compared to arrangements of these features having the same directionality along the longitudinal axis ($L^1$) of the device 100, 200. In certain aspects, the device has an overall stretch (i.e., resilient stretch) in the longitudinal axis/direction ($L^1$) of the device preferably ranging from 10-30% stretch of its initial state/length, and more preferably 18-25% stretch its initial state/length. Stretch below 10% will lead to too much resistance for a user when attempting to use the device while stretch above 30% is provides too little resistance to achieve the belt loop biasing characteristics/properties disclosed herein. In certain aspects, the device has minimal overall stretch (e.g., less than 1%, less than 0.5%, less than 0.1%) compared to the device's initial state in directions not within and/or parallel to the longitudinal axis/direction (L) of the device.

Figure 1B:
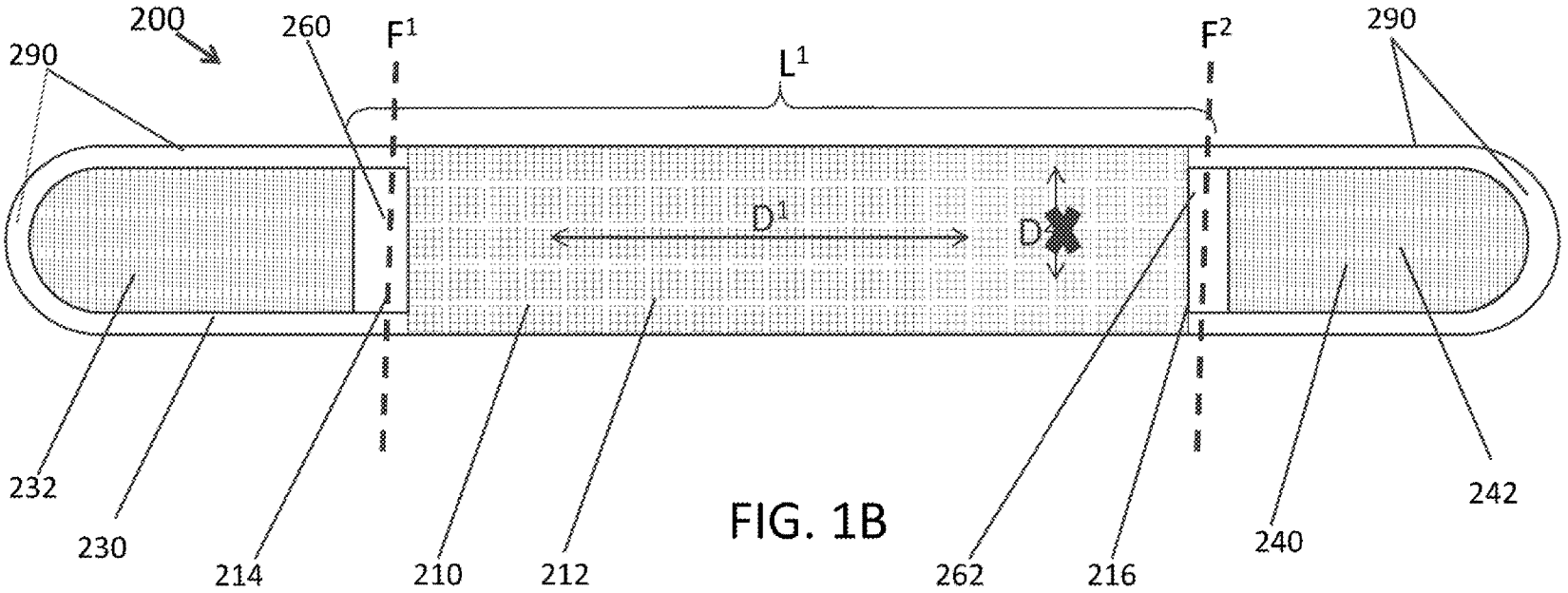
Figure 2A:
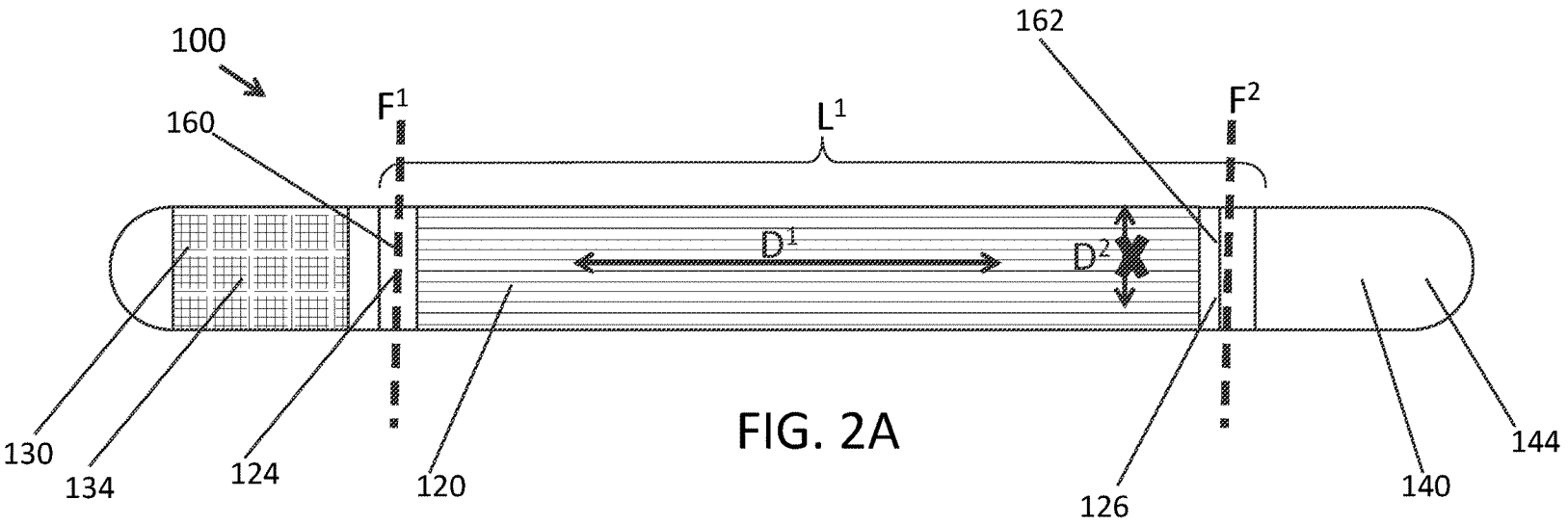
FIGS. 2A and 2B are back views of the dual band adjustable belt loop fastening devices having varied sizes.
Figure 2B:
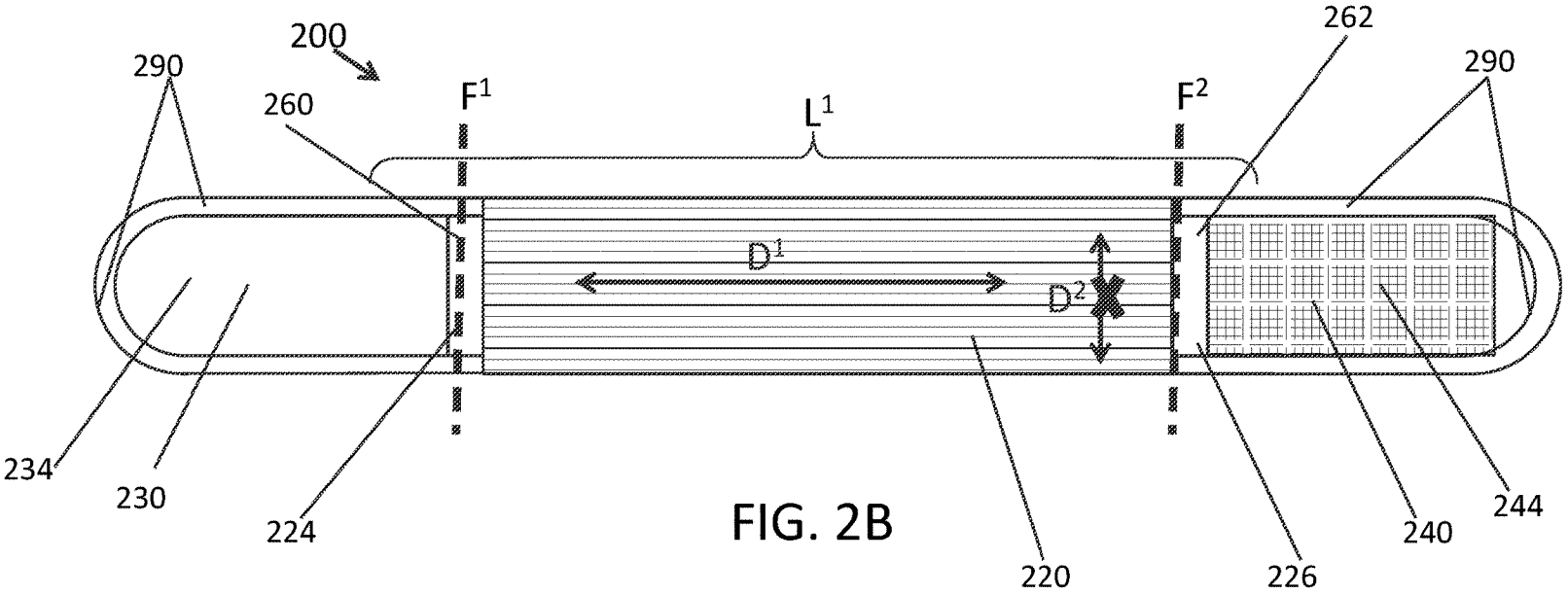
Figure 3A:
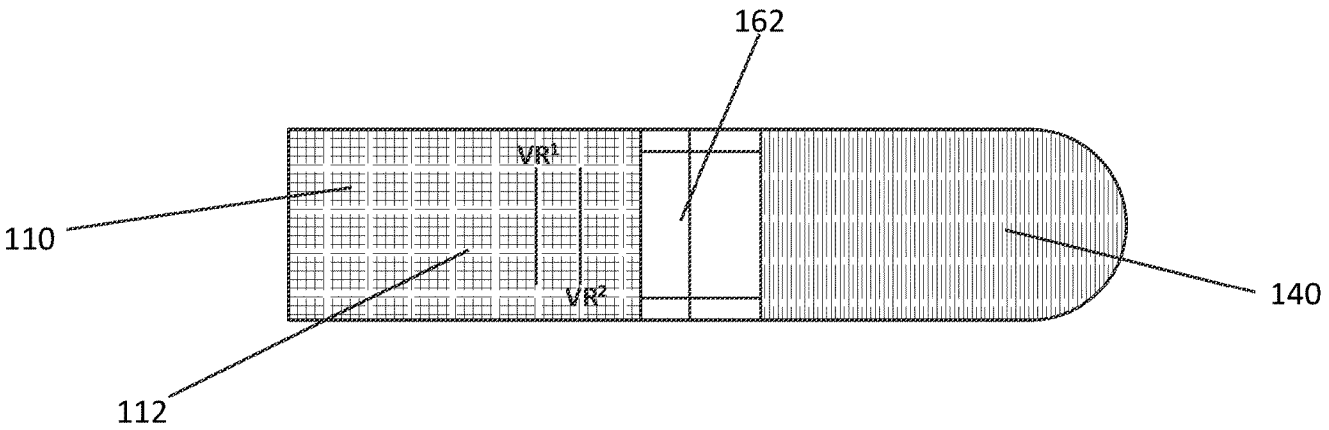
FIGS. 3A and 3B are magnified views of an end portion (fastening tab(s)) of the dual band adjustable belt loop fastening devices of FIGS. 1A and 1B respectively.
Figure 3B:
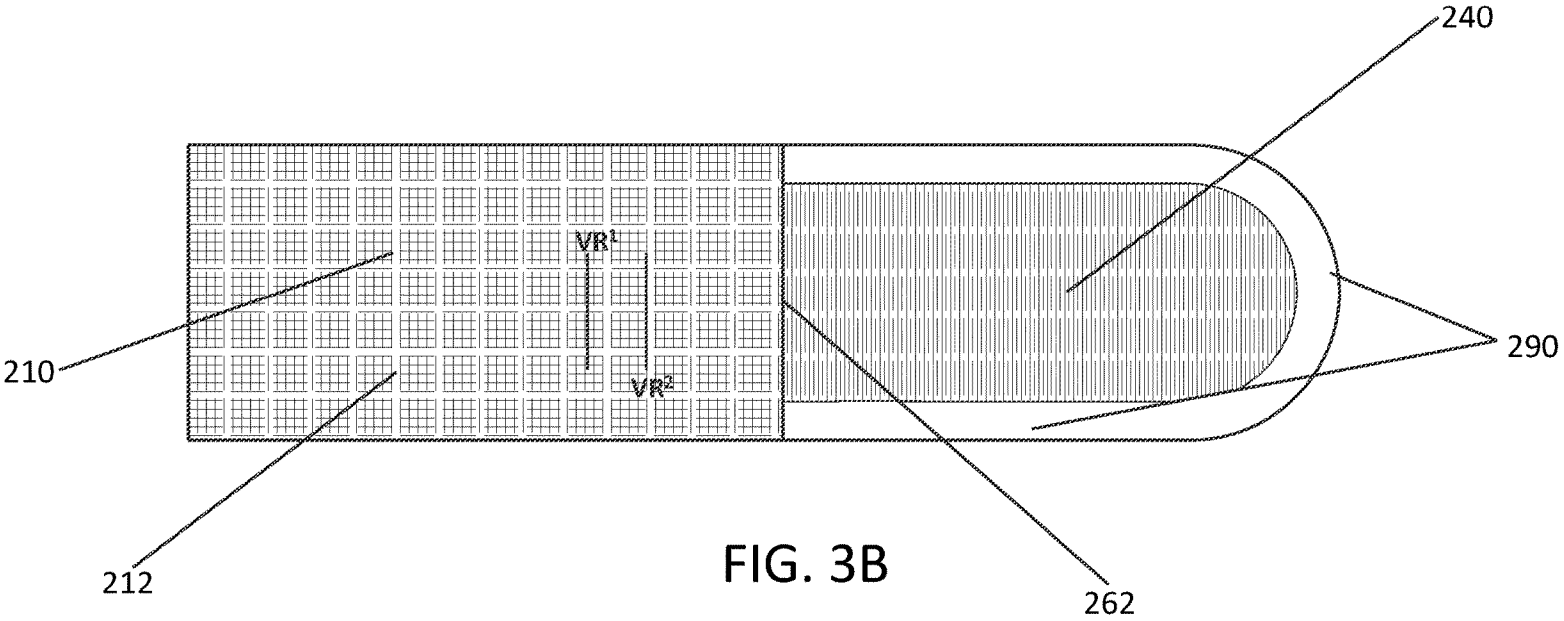
Figure 4A:
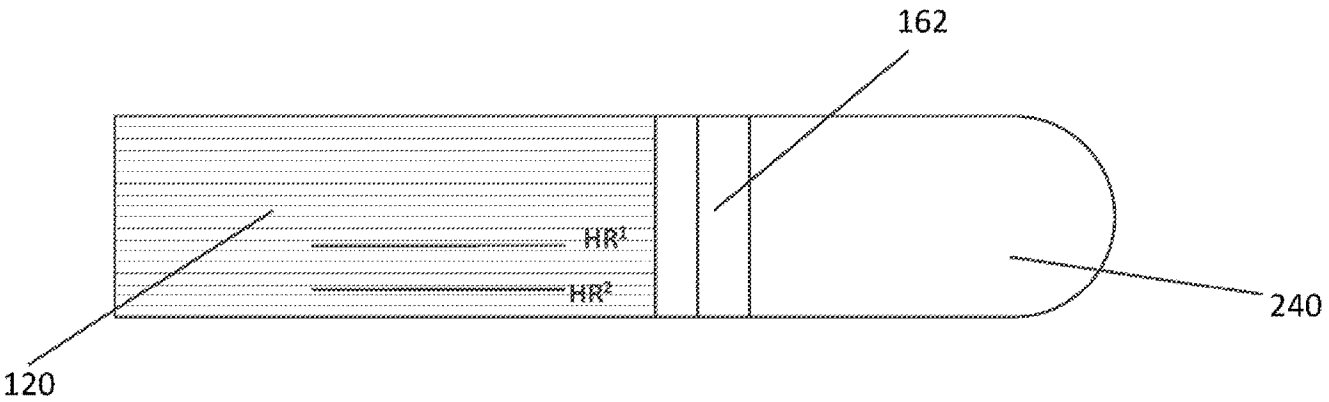
FIGS. 4A and 4B are magnified views of an end portion (fastening tab(s)) of the dual band adjustable belt loop fastening devices of FIGS. 2A and 2B respectively.
Figure 4B:
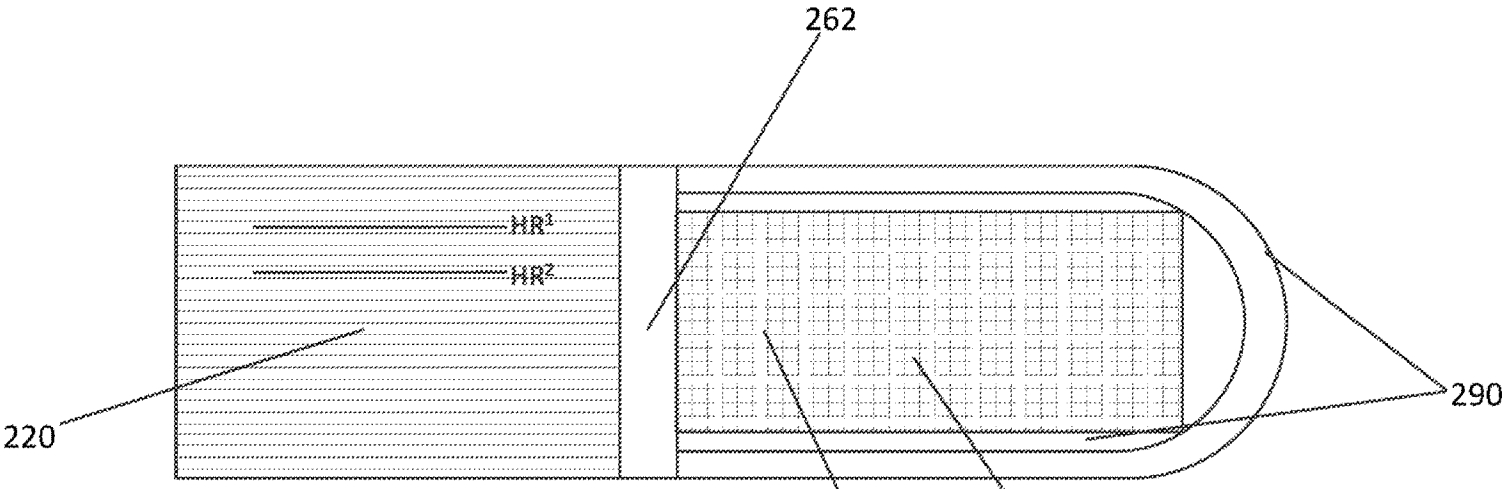
Figure 5A:
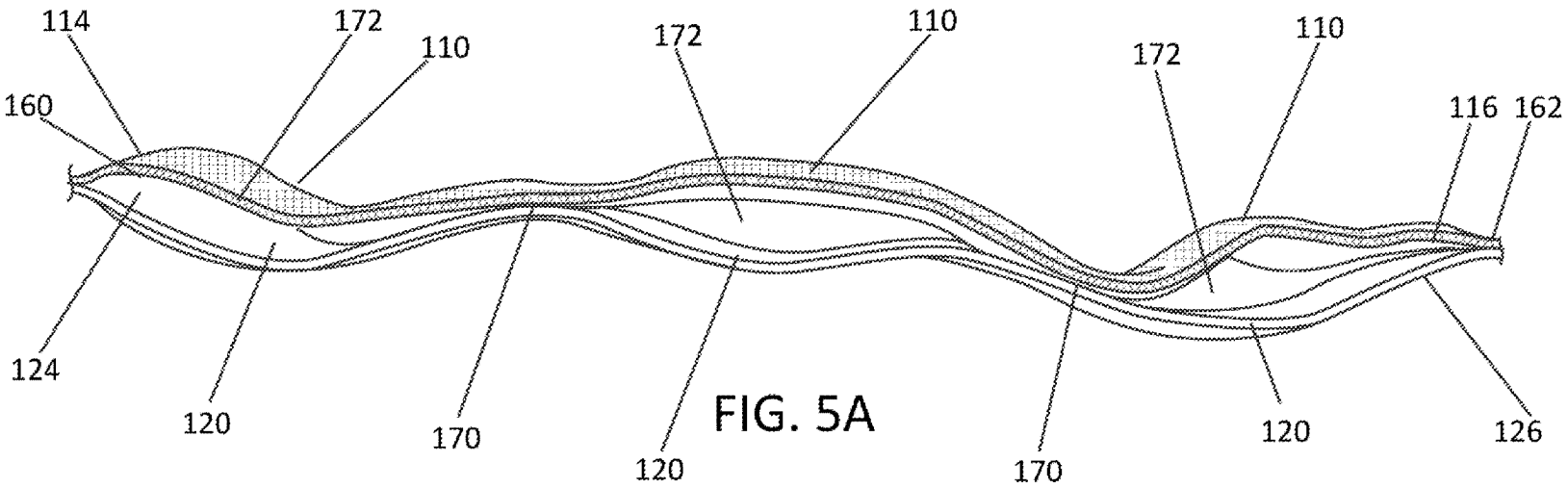
FIGS. 5A and 5B are magnified bottom views of the dual band adjustable belt loop fastening devices of FIGS. 1A and 1B in Which the top view is a mirror image thereof.
Figure 5B:
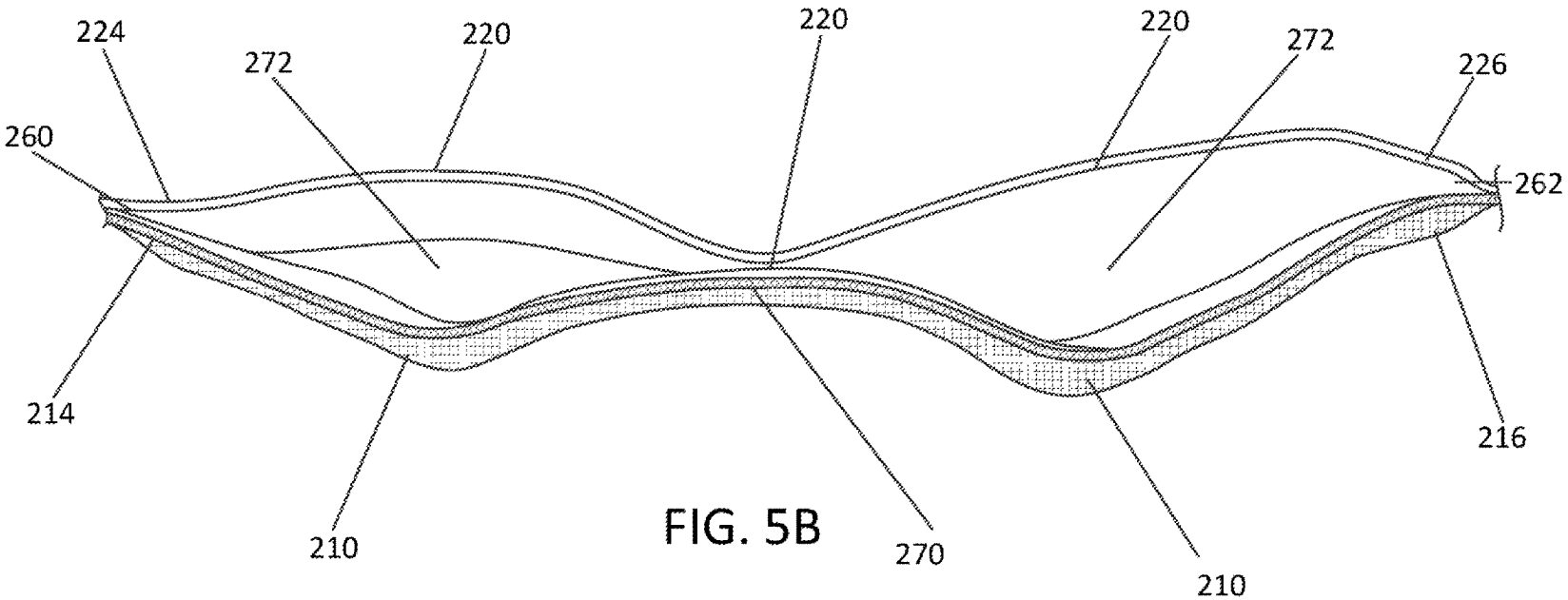
Figure 6A:
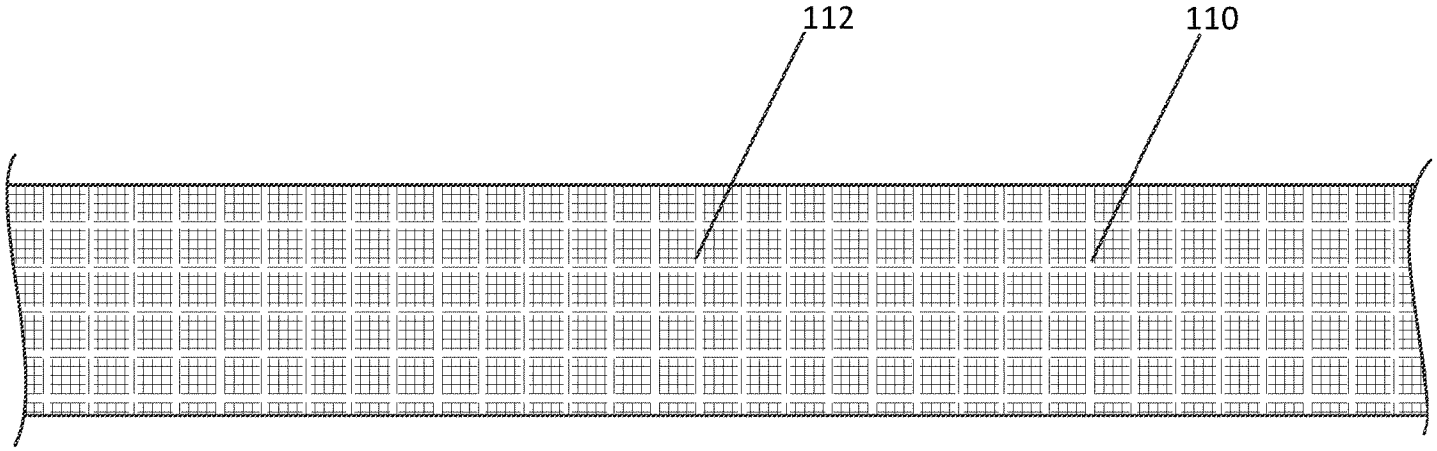
FIGS. 6A and 6B are magnified front views of a first band in each of the dual band adjustable belt loop fastening devices of FIGS. 1A and 1B respectively.
Figure 6B:
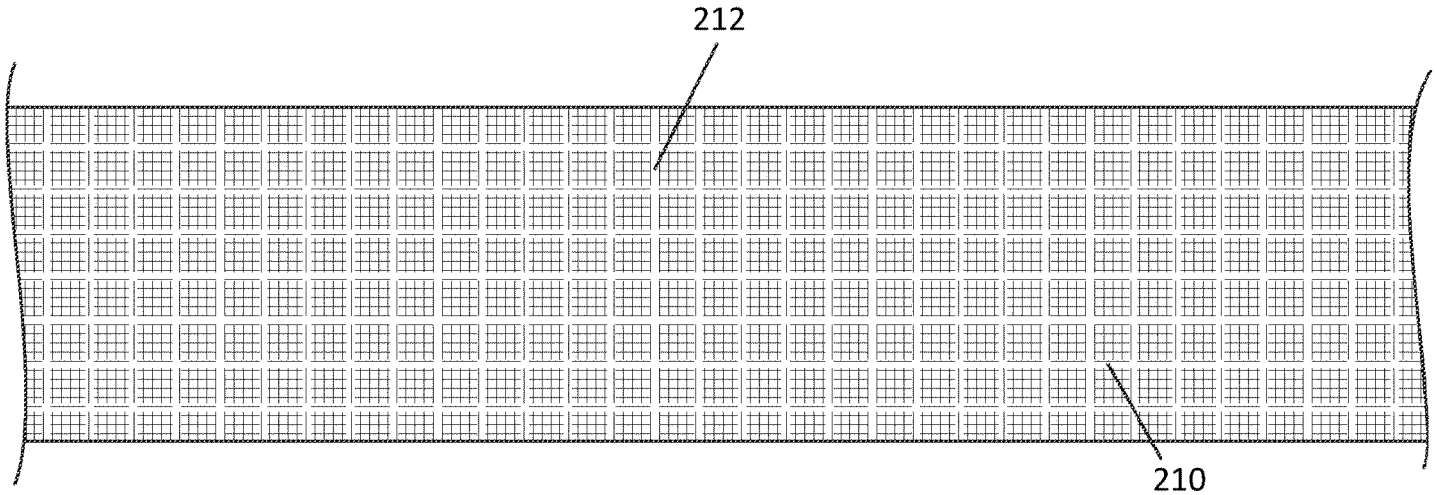
Figure 7A:
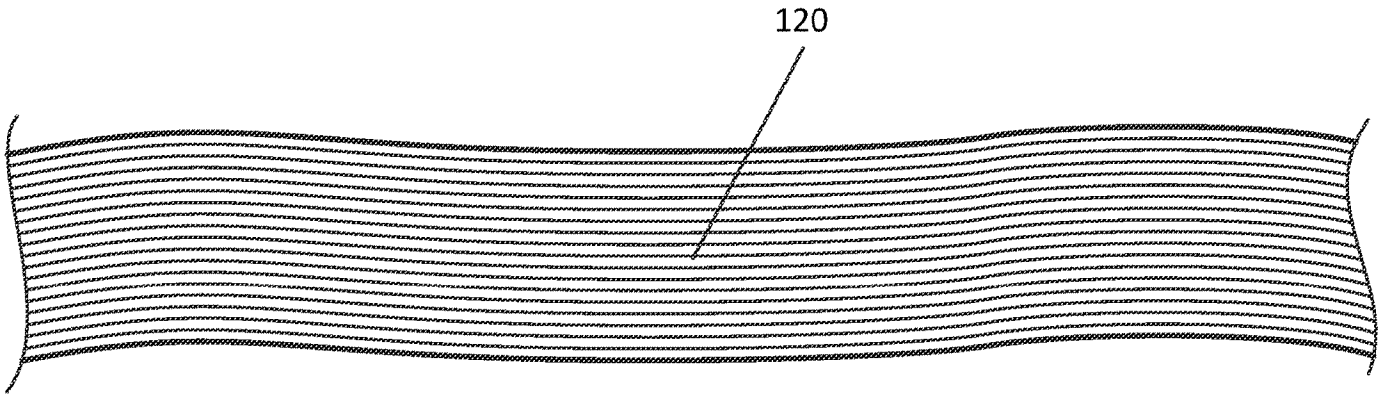
FIGS. 7A and 7B are magnified back views of a second band in each of dual band adjustable belt loop fastening devices of FIGS. 1A and 1B respectively.
Figure 7B:
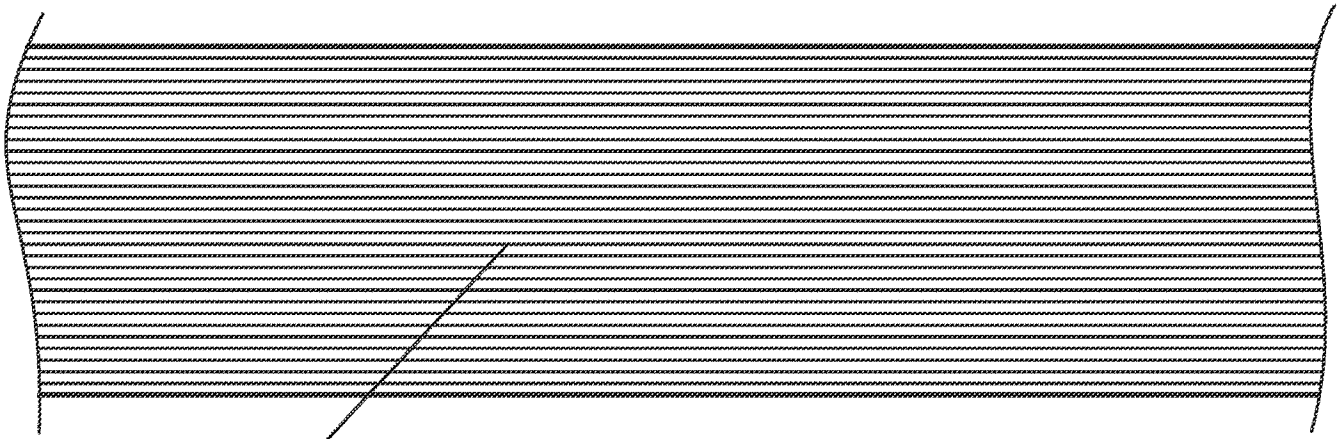
Figure 8:
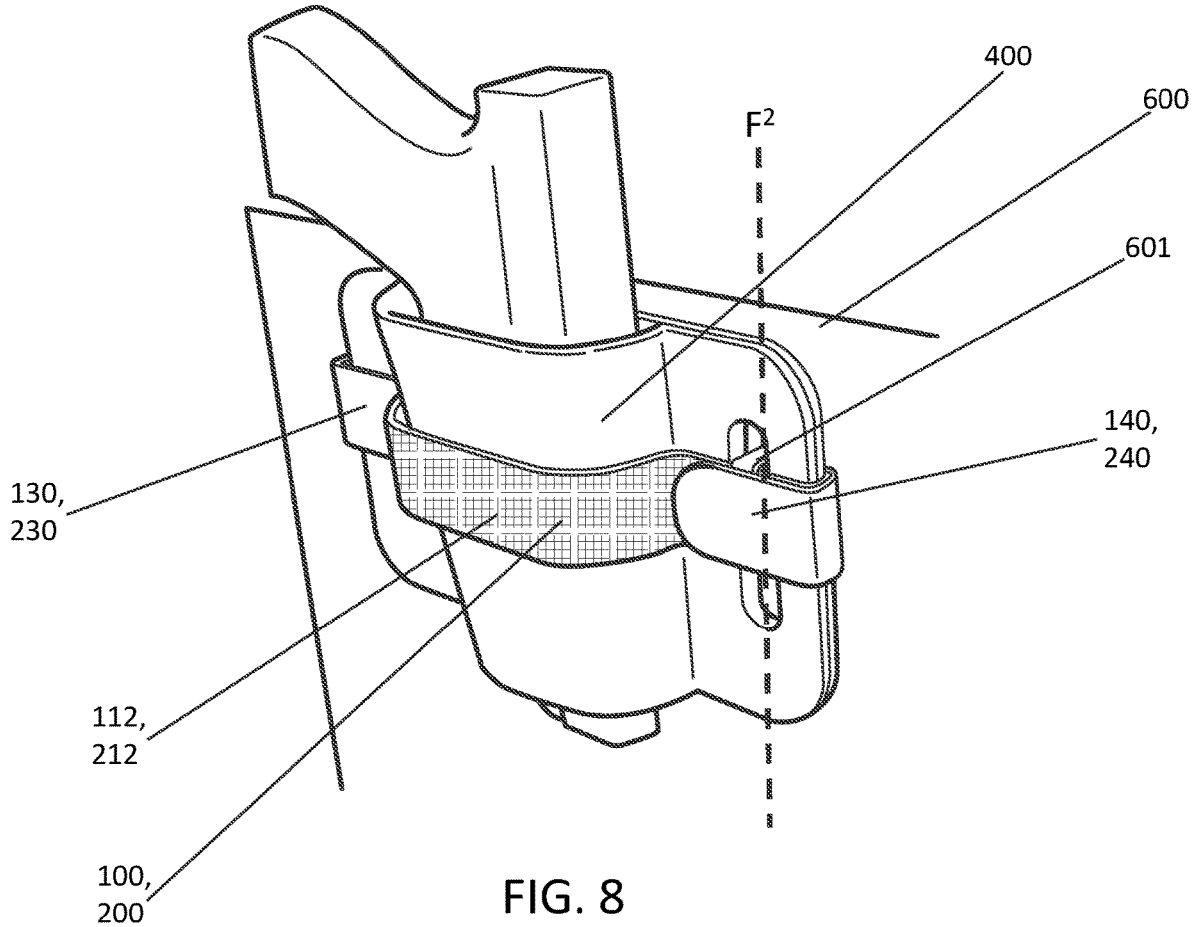
FIG. 8 depicts a dual band adjustable belt loop fastening device affixing a holster thereon that is positioned between two belt loops of a wearer.
Figure 9:
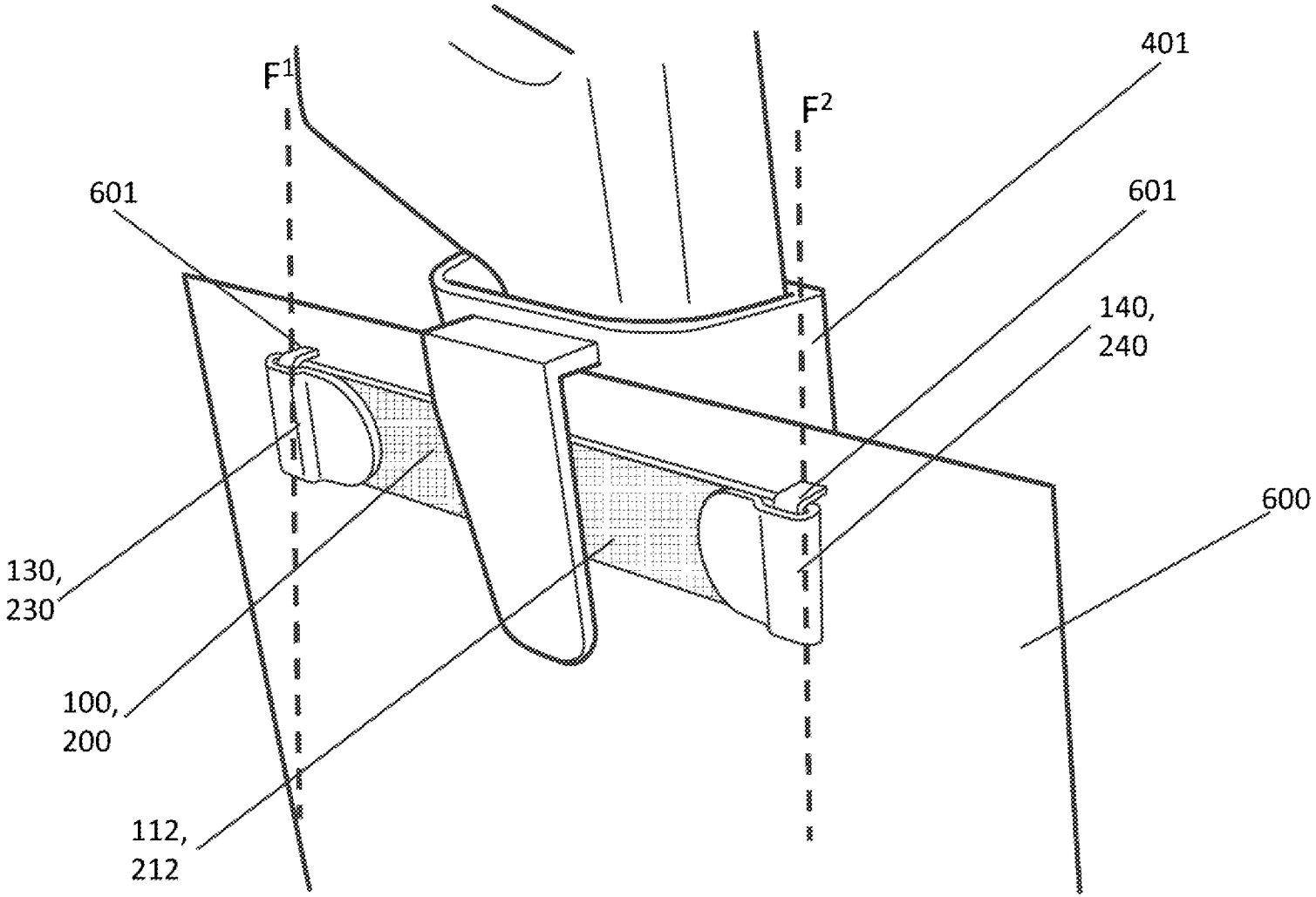
FIG. 9 depicts a dual band adjustable belt loop fastening device affixing another holster thereon that is positioned between two belt loops of a wearer.
Figure 10B:
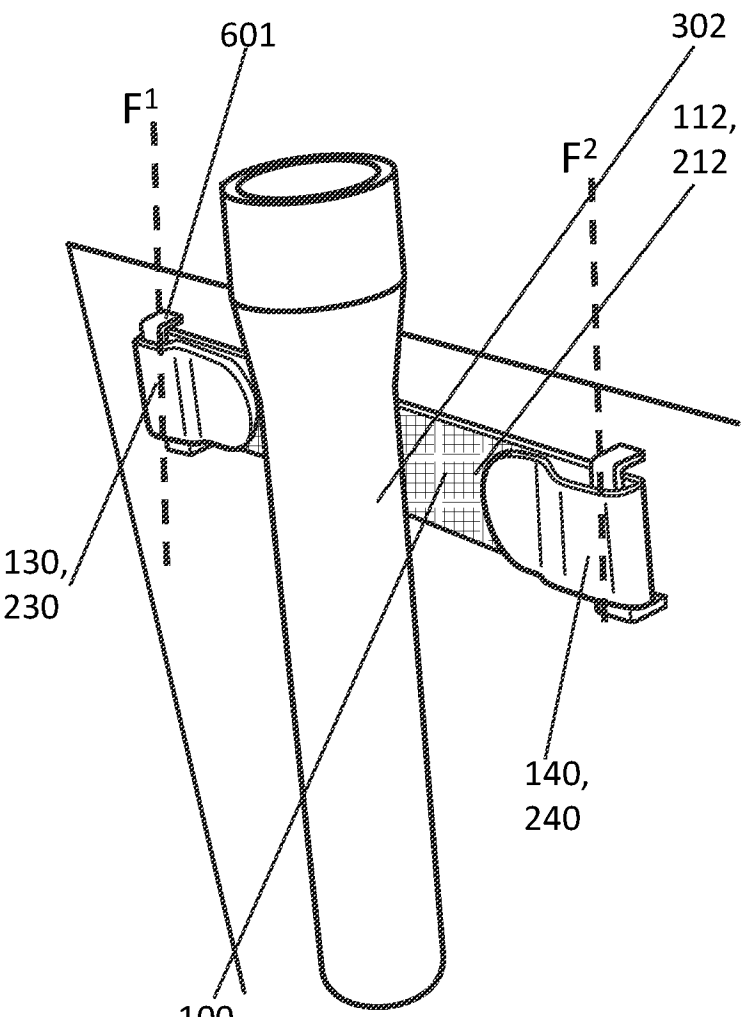
FIG. 10B depicts dual band adjustable belt loop fastening device affixing a flash light thereon that is positioned between two belt loops of a wearer.
Figure 10A:
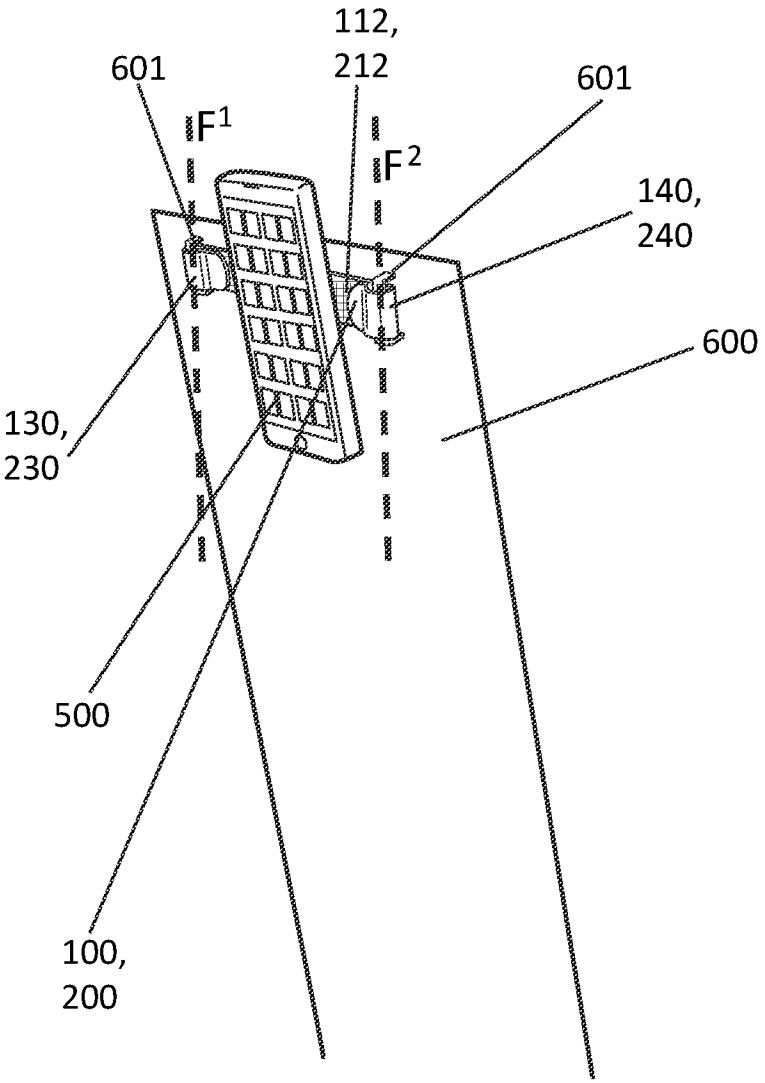
FIG. 10A depicts a dual band adjustable belt loop fastening devices affixing a smartphone thereon that is positioned between two belt loops of a wearer.
Figure 10D:
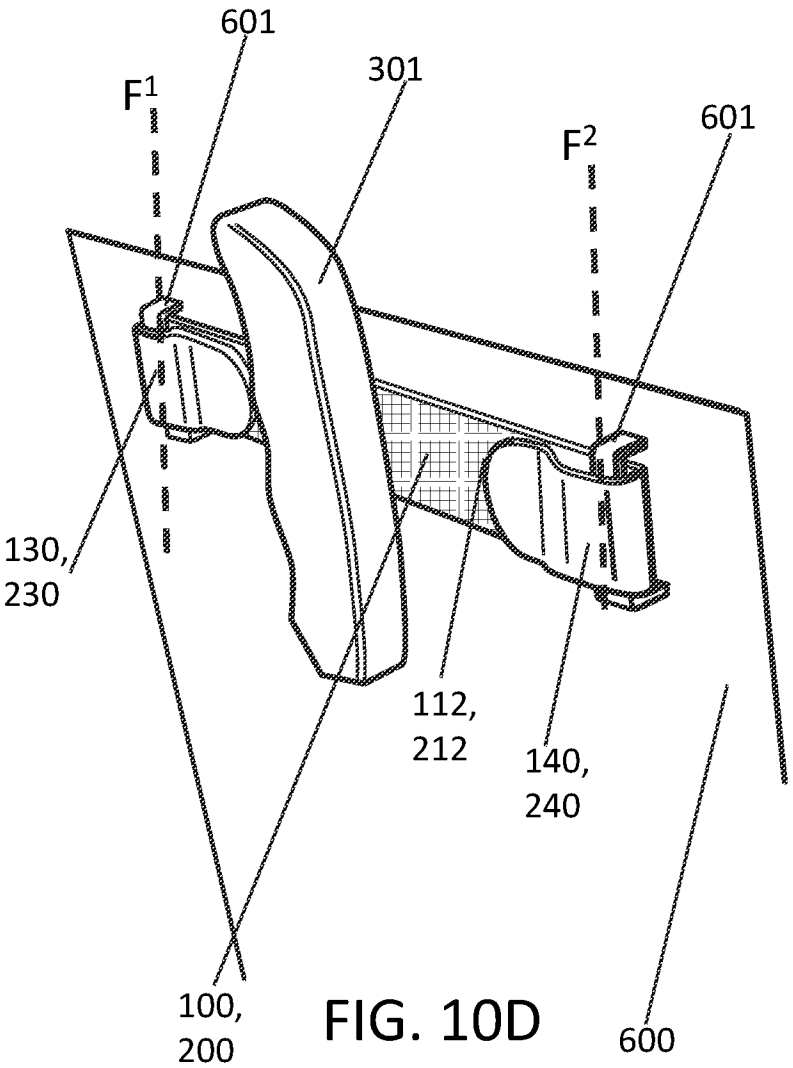
FIG. 10D depicts dual band adjustable belt loop fastening device affixing a knife thereon that is positioned between two belt loops of a wearer.
Figure 10C:
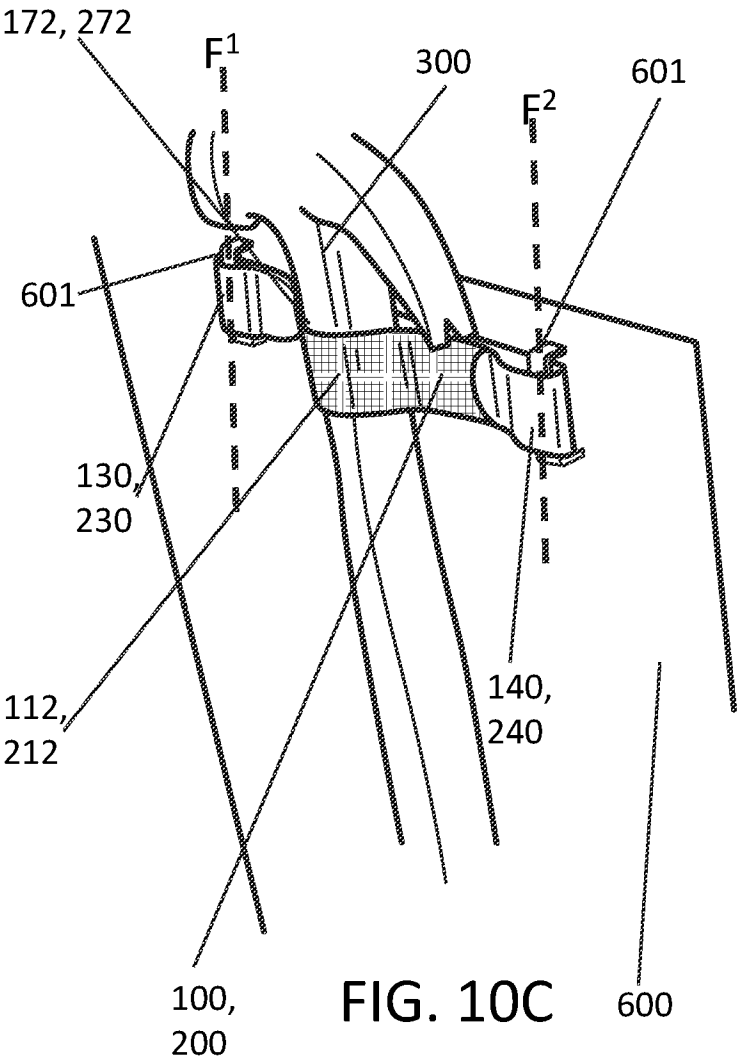
FIG. 10C depicts dual band adjustable belt loop fastening device affixing a hammer thereon that is positioned between two belt loops of a wearer.

Regarding the overall device 100, 200 construction and as further shown for example in FIGS. 5A and 5B in view of FIGS. 1A and 1B, the first ends 114, 124, 214, 224 of the first 110, 210 and second 120, 220 elastic bands of the dual band adjustable belt loop fastening device 100, 200 converge with one another at a connection point 160, 260 of the first fastening tab with each first end of the first and second elastic band and the first fastening tab 130, 230 being permanently attached to one another, and the second ends 116, 126, 216, 226 of the first 110, 210 and second 120, 220 elastic bands of dual band adjustable belt loop fastening device converge with one another at a connection point 162, 262 of the second fastening tab with each second end of the first 110, 210 and second 120, 220 elastic bands and the end of the second fastening tab 140, 240 being permanently attached to one another.

Also, in further view of FIGS. 5A and SB, the first 110, 210 and second 120, 220 elastic bands of the dual band adjustable belt loop fastening device 100, 200 are permanently secured and/or attached to one another 170, 270 internally within the device along the longitudinal axis ($L^1$) of the device and form a plurality of openings 172, 272 extending from a top to bottom of the device along the longitudinal axis of the device, the plurality of openings formed in between the first ends and second ends of the first 114, 124, 214, 224 and second 116, 126, 216, 226 ends of the first 110, 210 and second 120, 220 elastic bands. In certain aspects, the first 110, 210 and second 120, 220 elastic bands of the dual band adjustable belt loop fastening device 100, 200 are permanently stitched to one another 170, 270, and in certain aspects the stitching pattern has a predetermined shape, for example, a square, rectangular, or triangle shape, with portions of the stitching pattern being parallel to the device's longitudinal axis ($L^1$) while other portions of the stitching pattern are angled and/or transverse to the device's longitudinal axis ($L^1$). The above mentioned stitching patterns function to better permanently secure each elastic band to one another and better improve durability of the device after repeated use when compared to, for example, a linear stitch pattern that is either only parallel with the device's longitudinal axis ($L^1$), angled in only one direction relative to the device's longitudinal axis ($L^1$), or is only perpendicular relative to the device's longitudinal axis ($L^1$). As further shown in FIGS. 5A and 5B, each opening of the plurality of openings 172, 272 of the dual band adjustable belt loop fastening device 100, 200 extend from a top to bottom of the device along the longitudinal axis ($L^1$) of the device is configured to receive items therein and/or securely attach items onto the dual band adjustable belt loop fastening device. For example, FIGS. 8-10D further depict the device 100, 200 having various items such as tools (300 hammer, 301 knife, 302 flashlight), holsters 400, 401, smartphones 500, or any combination thereof temporarily affixed thereon or within an opening in the device.

Figure 11A:
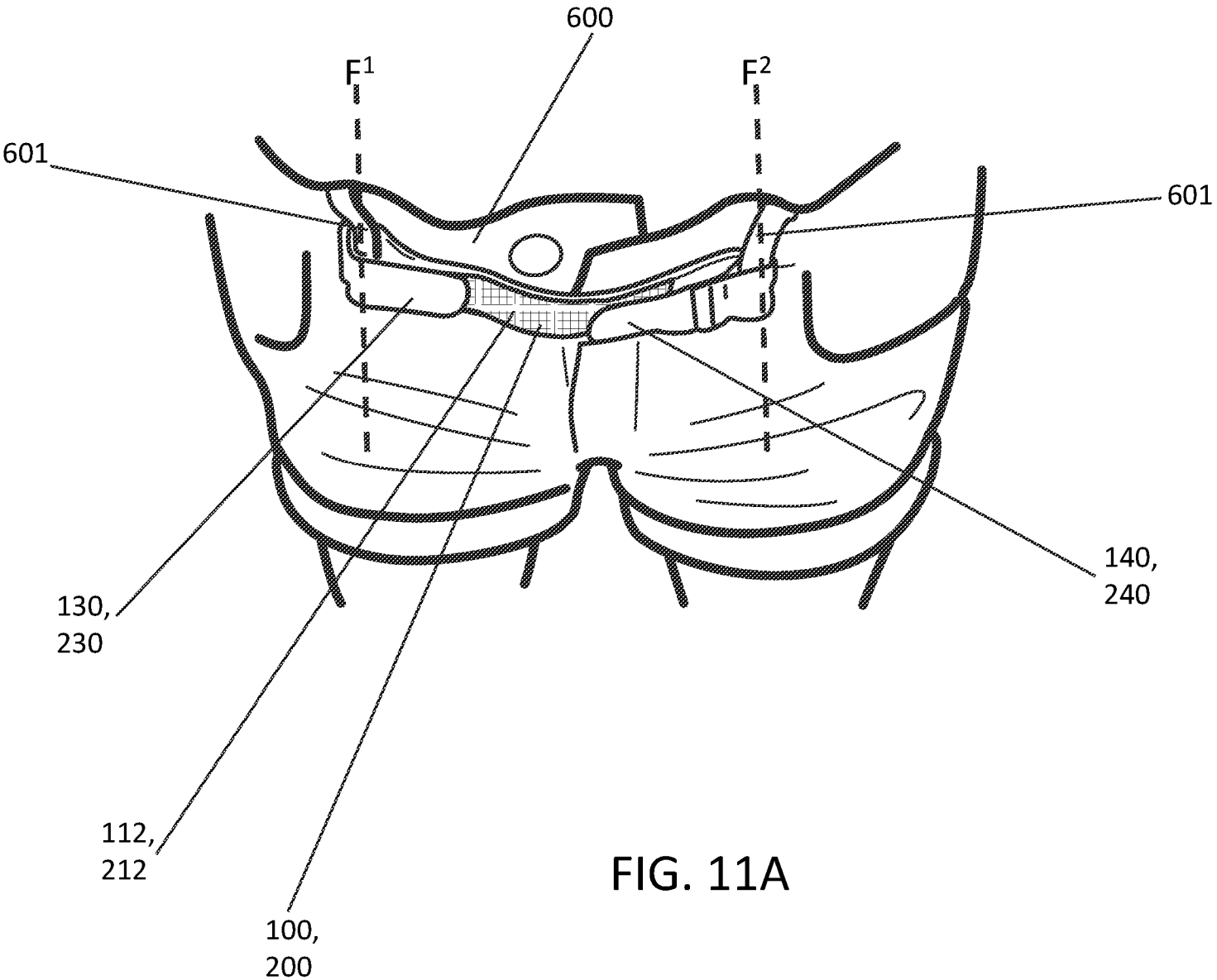
FIGS. 11A and 11B depicts dual band adjustable belt loop fastening devices affixed to belt loops of a wearer in use and having varied positions along a garment's waistline to further secure the garment to the garment wearer.
Figure 11B:
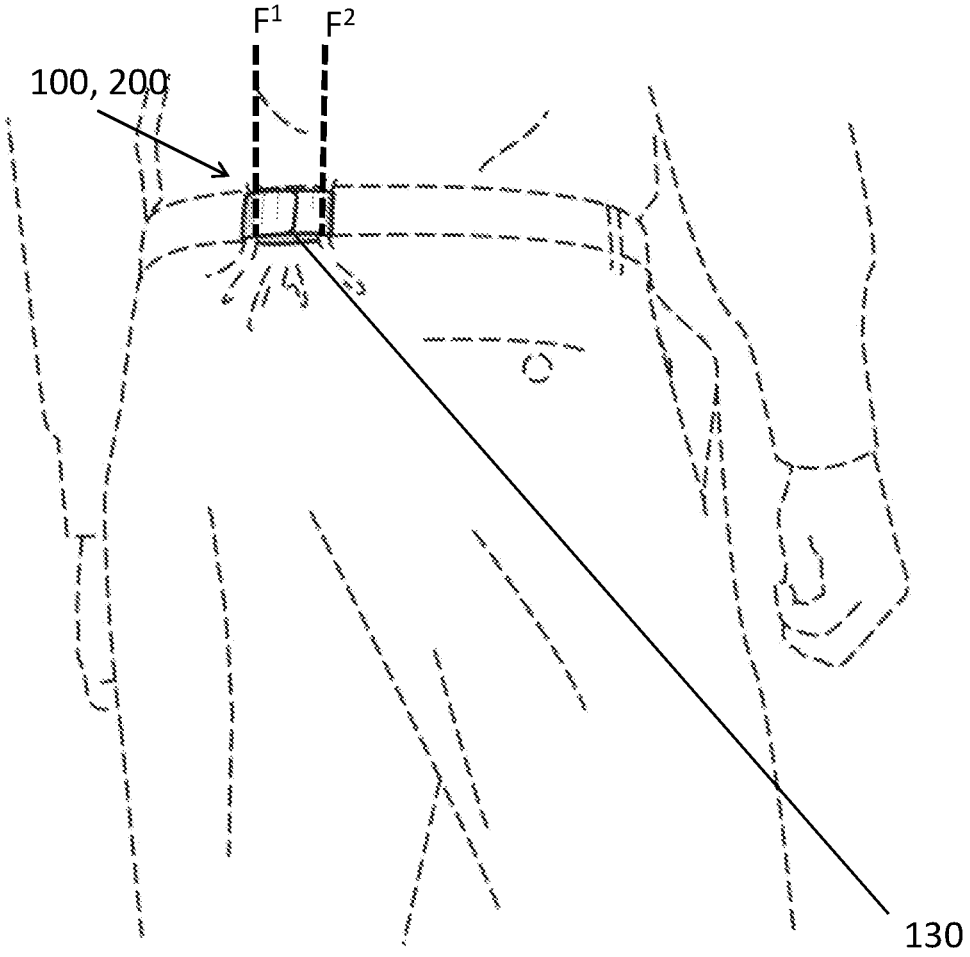

In further view of FIGS. 1A-4B, the first and second fastening tabs of the dual band adjustable belt loop fastening device each have opposing first 132, 142, 232, 242 and second 134, 144, 234, 244 faces. The first face 132, 142, 232, 242 of each fastening tab has the same hook or loop fasteners positioned thereon that are configured to fold inwardly towards (along axis $F^1$ and $F^2$ as shown for example in FIGS. 11A and 11B) one another along axes that are transverse to the longitudinal axis ($L^1$) of the dual band adjustable belt loop fastening device and securely engage a portion of the first or second elastic band (e.g., hook or loop fastener 112, 212) while in use to affix the device and selectively lessen distance between belt loops 601 of the garment 600 waistline, as shown, for example, in FIGS. 11A and 11B. In certain preferred aspects, the first 130, 230 and second 140, 240 fastening tabs are more rigid than each elastic band 110, 120, 210, 220. The first and second fastening tabs further comprise a non-woven substrate in which the hook or loop fasteners of the fastening tabs are permanently affixed to in which the non-woven and rigid substrate aids in permanently attaching the first and second ends of each elastic band to each fastening tab and further aids in use and durability of the devices disclosed herein. In certain aspects, a hook and loop fastener 280 is arranged on a second face of either the first or second fastening tab but not both fastening tabs and is further configured to engage the hook and loop fasteners arranged on the first face of the other fastening tab while in use. This arrangement of hook and loop fasteners allow the device to achieve the various conformations depicted in FIGS. 10A-11B while in use. For example, FIGS. 10A-11A depicted a first conformation in which the fastening tabs 130, 140, 230, 240 are folded along folding axis ($F^1$ or $F^2$) inwardly towards one another and are engaged to portions of one of the elastic bands such that the fastening tabs (via complementary hook and loop fasteners/fastening engagement) are substantially co-planar in a different plane relative to elastic bands 110, 120, 210, 220. FIG. 11B depicts a second conformation of the device 100, 200 while in use in which the fastening tabs 130, 140, 230, 240 are folded along folding axis ($F^1$ or $F^2$) inwardly towards one another and a lower face of one fastening tab engages an upper face of another fastening tab (via complementary hook and loop fasteners/fastening engagement) such that the fastening tabs are directly laterally adjacent to one another but are not co-planar with each other or the elastic bands 110, 120, 210, 220.

As further depicted in FIGS. 1B, 2B, 3B, and 4B, in certain aspects, the devices disclosed herein further include a protective fabric 290 that is permanently attached over and wrapped around the peripheral edges of each fastening tab (e.g., 230, 240) to minimize abrasiveness and potential lacerations occurring when a device wearer contacts/touches the peripheral edges of each fastening tab (230, 240).

FIGS. 8-11B depict specific uses and methods of use of the devices 100, 200 disclosed herein. For example, disclosed herein is a method of selectively lessening a distance between a plurality of belt loops comprising: (a) threading a dual band adjustable belt loop device disclosed herein between a plurality of belt loops; (b) engaging and securing a first belt loop within a first fastening tab of the device; and (c) applying force towards a second belt loop by pulling a second end of the adjustable belt loop device in a direction opposite the first belt loop; and engaging the second fastening tab of the dual band adjustable belt loop device to another portion of the device to selectively lessen distance between the first and second belt loops by gripping and applying force directly to the belt loops to bias the first and second belt loops towards one another, wherein: the dual band adjustable belt loop fastening device comprises: (i) a first and second elastic band 110, 120, 210, 220 that are formed of different materials and are directly laterally adjacent to one another within the dual band adjustable belt loop fastening device, each elastic band having a substantially same elongated shape and a first end and a second end that are spaced apart relative to one another; and (ii) a first fastening tab 130, 140, 230, 240 directly permanently connected to each first end of each of the elastic bands and a second fastening tab directly permanently connected to each second end of each of the elastic bands, each fastening tab is more rigid than each elastic band and configured to fold inwardly towards one another along a longitudinal axis ($L^1$) of the dual band adjustable belt loop fastening device and securely engage a portion of the first or second elastic band while in use to affix the device and selectively lessen distance between belt loops of the garment waistline. In certain aspects and as alluded to above, the device preferably includes a plurality of openings in which each of the plurality of openings extend from a top to bottom of the device along the longitudinal axis of the device are configured to receive items therein and/or securely attach items onto the device. The methods disclosed herein further include temporarily positioning and/or affixing a tool, holster, smartphone, or any combination thereof on or within an opening in the device until the device wearer selectively chooses to remove the items therefrom.

In certain aspects, for example, in the case of rapid weight gain (e.g., associated with pregnancy and/or a medical condition), the devices 100, 200 disclosed herein may be of particular use. As shown in FIG. 11A, for example, if one has gained weight rapidly, their wardrobe may no longer comfortably fit to their waste. In this instance, a button and/or zipper (and/or any other applicable fastening mechanism) on the garment may not be fastened and the device may be used to securely engage the two belt loops 601 at the front of the garment to secure the garment on the wearer. In certain aspects, a plurality of the devices 100, 200 (e.g., 2, 3, or 4) may be affixed to a garment wearer's waistline (e.g., on opposite sides of the waistline) to ensure that the garment is evenly positioned and fastened to the wearer.

Also disclosed herein is a kit comprising one or a plurality of dual band adjustable belt loop fastening device(s) 100, 200 disclosed herein and packaging with the one or plurality of adjustable belt loop fastening device(s) packaged therein.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A dual band adjustable belt loop fastening device configured to extend between and be affixed to a plurality of belt loops on a garment and, while in use and affixed to the plurality of belt loops, to selectively lessen distance between belt loops by applying force directly to the belt loops to bias two belt loops towards one another to secure a garment waistline to a wearer and also configured to affix items thereon or thereto, the dual band adjustable belt loop fastening device comprising:

(a) a first and second elastic band that are formed of different materials and are directly laterally adjacent to one another within the dual band adjustable belt loop fastening device, each elastic band having a substantially same elongated shape and a first end and a second end that are spaced apart relative to one another, and wherein each elastic band comprises a two way stretch fabric having greater stretch along the longitudinal axis of the device than in other directions of the device; and (b) a first fastening tab directly permanently connected to each first end of each of the elastic bands and a second fastening tab directly permanently connected to each second end of each of the elastic bands, each fastening tab is more rigid than each elastic band and configured to fold inwardly towards one another along a longitudinal axis of the dual band adjustable belt loop fastening device and securely engage a portion of the first or second elastic band while in use to affix the device and selectively lessen distance between belt loops of the garment waistline.

2. The dual band adjustable belt loop fastening device of claim 1, wherein one of the first and second elastic bands has less elasticity than the other elastic band.

3. The dual band adjustable belt loop fastening device of claim 2, wherein each elastic band is a woven fabric.

4. The dual band adjustable belt loop fastening device of claim 3, wherein the elastic band having the least elasticity of the first and second elastic bands comprises a nylon and polyester blend and the elastic band having the most elasticity of the first and second elastic bands is a polyester fabric.

5. The dual band adjustable belt loop of claim 4, wherein the elastic band having the least elasticity of the first and second elastic bands has hook or loop fasteners affixed on its outer surface that are configured to engage and temporarily fasten to the first and second fastening tabs.

6. The dual hand adjustable belt loop fastening device of claim 5, wherein the first ends of the first and second elastic bands converge with one another at a connection point of the first fastening tab with each first end and the first fastening tab permanently attached to one another, and the second ends of the first and second elastic bands converge with one another at a connection point of the second fastening tab with each second end and the second fastening tab permanently attached to one another.

7. The dual band adjustable belt loop fastening device of claim 6, wherein the first and second elastic bands are permanently secured to one another internally within the device along the longitudinal axis of the device and form a plurality of openings extending from a top to bottom of the device along the longitudinal axis of the device, the plurality of openings formed in between the first ends and second ends of the first and second elastic bands.

8. The dual band adjustable belt loop fastening device of claim 7, wherein each of the plurality of openings extending from a top to bottom of the device along the longitudinal axis of the device are configured to receive items therein and/or securely attach items onto the dual band adjustable belt loop fastening device.

9. The dual hand adjustable belt loop fastening device of claim 8, wherein the first and second fastening tabs each have opposing first and second faces in which the first face of each fastening tab has the same hook or loop fasteners positioned thereon that are configured to fold inwardly towards one another along axes that are transverse to the longitudinal axis of the dual band adjustable belt loop fastening device and securely engage a portion of the first or second elastic band while in use to affix the device and selectively lessen distance between belt loops of the garment waistline.

10. The dual band adjustable belt loop fastening device of claim 9, wherein a hook and loop fastener is arranged on a second face of either the first or second fastening tab but not both fastening tabs and is further configured to engage the hook and loop fasteners arranged on the first face of the other fastening tab while in use.

11. The dual band adjustable belt loop fastening device of claim 10, wherein a protective fabric is permanently attached over peripheral edges of each fastening tab to minimize abrasiveness and potential lacerations occurring when contacting the peripheral edges of each fastening tab.

12. The dual band adjustable belt loop fastening device of claim 11, wherein the device is configured to affix tools, holsters, smartphones, or any combination thereof on or within an opening in the device.

13. A kit comprising one or a plurality of adjustable belt loop fastening device(s) of claim 1 and packaging with the one or plurality of adjustable belt loop fastening device(s) packaged therein.

* * * * *